US008186615B2

(12) United States Patent
Uebori et al.

(10) Patent No.: US 8,186,615 B2
(45) Date of Patent: May 29, 2012

(54) ROTOR HEAD OF REMOTELY-CONTROLLED HELICOPTER AND REMOTELY-CONTROLLED HELICOPTER

(75) Inventors: Takakazu Uebori, Fuchu (JP); Kimio Nakamura, Kawasaki (JP)

(73) Assignee: Hirobo Co., Ltd, Hiroshima (JP)

( * ) Notice: Subject to any disclaimer, the term of this patent is extended or adjusted under 35 U.S.C. 154(b) by 0 days.

(21) Appl. No.: 12/667,495

(22) PCT Filed: Jul. 2, 2007

(86) PCT No.: PCT/JP2007/063232

§ 371 (c)(1),
(2), (4) Date: Dec. 31, 2009

(87) PCT Pub. No.: WO2009/004705

PCT Pub. Date: Jan. 8, 2009

(65) Prior Publication Data

US 2010/0196161 A1 Aug. 5, 2010

(51) Int. Cl.
*B64C 27/52* (2006.01)
*B64C 27/54* (2006.01)

(52) U.S. Cl. ..... 244/17.25

(58) Field of Classification Search ..... 244/6, 17.11, 244/17.25

See application file for complete search history.

(56) References Cited

U.S. PATENT DOCUMENTS

| | | | | |
|---|---|---|---|---|
| 2,161,801 | A * | 6/1939 | Daland et al. | 416/108 |
| 3,246,862 | A | 4/1966 | Celniker et al. | |
| 4,118,143 | A * | 10/1978 | Kavan | 416/18 |
| 4,445,421 | A | 5/1984 | Walker et al. | |
| 4,598,887 | A | 7/1986 | Jordan | |
| 5,971,320 | A * | 10/1999 | Jermyn et al. | 244/17.25 |
| 6,886,777 | B2 * | 5/2005 | Rock | 244/17.23 |
| 2004/0184915 | A1 * | 9/2004 | Kunii et al. | 416/114 |
| 2007/0105475 | A1 * | 5/2007 | Gotou et al. | 446/37 |

FOREIGN PATENT DOCUMENTS

| | | | |
|---|---|---|---|
| JP | 59-59595 | A | 4/1984 |
| JP | 6-7751 | A | 8/1989 |
| JP | 6-10306 | A | 2/1994 |
| JP | 9-512515 | A | 12/1997 |
| JP | 2000-272594 | A | 10/2000 |
| JP | 2003-103066 | A | 4/2003 |
| JP | 2004-121798 | A | 4/2004 |
| WO | 95/29842 | A2 | 11/1995 |

OTHER PUBLICATIONS

English machine translation JP 2004121798 A.*

* cited by examiner

*Primary Examiner* — Timothy D Collins
*Assistant Examiner* — Joseph W Sanderson
(74) *Attorney, Agent, or Firm* — Sughrue Mion, PLLC

(57) ABSTRACT

A remote controlled helicopter of a single rotor type to be used indoors, having a flying operation that can be stabilized and operability that can be improved. The helicopter includes a center hub that supports a rotor head to a mainmast, and is divided into an upper center hub and a lower center hub. The upper and the lower center hubs are fixed around the shaft of the mainmast with a predetermined angle. A phase angle of a main rotor as an output with respect to an operation input from a swash plate becomes an acute angle, and the main rotor and a stabilizer are mounted to rotate with a phase difference of the acute angle.

6 Claims, 7 Drawing Sheets

ROTOR HEAD OF REMOTELY-CONTROLLED HELICOPTER AND REMOTELY-CONTROLLED HELICOPTER

TECHNICAL FIELD

The present invention relates to a rotor head of a remotely controlled helicopter (hereinafter, referred to as R/C helicopter) that flies by remote control based on wired communication or radio control based on wireless communication, and more particularly, to a mechanism of a rotor head that is suitable for an R/C helicopter of a single rotor type that is configured to incline a rotation surface of a main rotor by a Bell type, a Hiller type, or Bell-Hiller type.

BACKGROUND ART OF THE INVENTION

An R/C helicopter rotates a main rotor blade that is applied with an angle of attack and generates lifting force, changes the angle of attack of the main rotor blade through a link mechanism from a swash plate mounted to a base portion of a mainmast, and inclines a rotation surface of a rotor using the change in the lifting force to generate thrust force in an inclined direction, thereby flying.

As a method that controls a pitch angle of the main rotor blade, a Bell type that directly inclines the main rotor blade through the link mechanism from the swash plate and a Hiller type that inclines a stabilizer blade through the link mechanism from the swash plate, transmits a balance change in the lifting force generated by inclining the stabilizer blade to the main rotor blade, and changes the pitch angle are used. In the R/C helicopter, since excellent steering responsiveness is obtained by control of a Bell-Hiller type corresponding to a combination of the Bell type and the Hiller type, the Bell-Hiller type is widely used in general (for example, refer to Patent Documents 1 and 2).

The reason why the rotation surface of the main rotor is controlled to be inclined in the same direction as the swash plate by the inclining operation of the swash plate is as follows. If force is applied to a rotating object, a gyro precession where an effect of the force appears in a progress direction of a rotation of 90 degrees acts. In order to cause the main rotor and the stabilizer to control external stress applied to an airframe by an effect of the gyro precession and stabilize the flying operation, in the R/C helicopter of the Bell-Hiller type, a phase difference of an output with respect to an operation input is set as 90 degrees, and the stabilizer and the main rotor are disposed in directions orthogonal to each other.

[Patent Document 1] Japanese Utility Model Application No. H6-7751

[Patent Document 2] Japanese Patent Application Laid-Open No. 2003-103066

DISCLOSURE OF THE INVENTION

Problem to be Resolved by the Invention

In recent years, in indoor living, in order to enjoy a flying operation of the R/C helicopter, an indoor helicopter that has the airframe weight of 400 g or less has been demanded.

In the R/C helicopter of the Bell-Hiller control type that has been commercially marketed, there various types of R/C helicopters exist, such as one which the total length of the airframe is about 1 m and the weight is about 3 kg and one which the total length over 2 m. However all of them are developed for the purpose of enjoying outdoor flying control. For this reason, it is increasingly required to develop indoor helicopters.

In order to adjust to the above requirement, if the conventionally used R/C helicopter of the Bell-Hill type is scaled down and the airframe thereof is small-sized and light-weighted, a helicopter that enables an indoor flying operation can be configured.

However, when the airframe is small-sized and light-weighted to be used for an indoor helicopter, the flying operation is unstable and the control operation becomes extremely difficult. Even in a simple operation from leaving the ground to hovering, a sophisticated operation technique of a level higher than a level of when a large outdoor machine is operated is needed. If an operation stick of a transmitter (propo) is operated to fly the airframe backward and forward or leftward and rightward, the flying posture is collapsed or the airframe shakes. At this time, if a user steers the airframe to stabilize the flying operation, the airframe shows the behavior of the airframe being greatly rocked in an operation direction, and the user cannot cause the airframe to smoothly fly in a desired direction.

With respect to the behavior of the airframe, stability of the airframe can be improved by changing the shape of the blade of the main rotor or the blade of the stabilizer or precisely adjusting a Bell-Hiller ratio of a rotor head. However, even though the above adjustment is performed, when the operation of moving the airframe in a desired direction, that is, inclining the swash plate and changing the rotation surface of the main rotor is performed, the user cannot accurately and stably fly the airframe in the desired direction, the collapse of the flying posture is inevitably generated, and operability of the conventional outdoor R/C helicopter is not obtained.

The prevent invention has been made in view of the above-described problems in the related art, and it is an object of the present invention to stabilize the flying operation of an R/C helicopter and improve operability thereof, when the R/C helicopter is configured to have a small size.

Means for Solving the Problem

In a rotor head of a remotely controlled helicopter of a single rotor type, which is configured such that a stabilizer or a main rotor is connected to a swash plate through a link mechanism, pitch angles of the stabilizer and the main rotor are controlled by inclining the swash plate, and the remotely controlled helicopter flies, the rotor head is configured such that a gyro pre-session of the main rotor as an output with respect to an operation input from the swash plate by a decrease in the weight of the main rotor appears in a range lower than 90 degrees, and the main rotor and the stabilizer are mounted to rotate with a phase difference of an acute angle.

The rotor head has the configuration of a Bell-Hiller type where the stabilizer and the main rotor are connected to the swash plate through the link mechanism.

In the above configuration, preferably, a center hub that supports the rotor head to a mainmast is divided into an upper center hub and a lower center hub, and the upper and the lower center hubs are fixed around the shaft of the mainmast with a predetermined angle, that is a predetermined position, and the main rotor and the stabilizer are mounted to the upper and the lower center hubs, respectively.

Further, an R/C helicopter according to the present invention comprises the rotor head of the above configuration.

Not only control operation of an indoor R/C helicopter that is configured to be able to fly indoors is known to be very difficult, but also that of an R/C helicopter of a Bell-Hiller type is very difficult. One of reasons why the control operation is difficult is that the indoor helicopter is light-weighted and the flying operation thereof is affected by an indoor moderate wind.

In the related art, in general, the flying operation of the indoor helicopter becomes unstable due to the light weight of the airframe. That is, the flying operation cannot be prevented from becoming unstable, as long as the weight of the indoor airframe cannot be increased. Therefore, it is thought that in order to stabilize the flying operation, in addition to a Bell-Hiller ratio of the airframe, adjustment places and a characteristic of a control signal output from a transmitter need to be precisely adjusted, and operation skills of an operator of the transmitter need to be raised.

As a result of various studies on a method of stabilizing the flying operation of the R/C helicopter configured to have a small size to be used indoors, the inventors of the present invention have found that a gyro pre-session effect appears at a position different from a common position, when the main rotor blades are formed of a light-weighted material and the main rotor is configured to have light weight, and have reached the invention of the R/C helicopter having the above configuration.

That is, as in the outdoor R/C helicopter, when the main rotor blades are made of wood or FRP and have high rigidity and heavy weight, the gyro precession appears after being delayed by 90 degrees with respect to an input. Using these characteristic, a steering operation is input at an advanced place by 90 degrees with respect to a moving direction of the main rotor, that is, the swash plate is inclined at an advanced position by 90 degrees, and the pitch angle of the main rotor is changed.

Meanwhile, it is revealed that the gyro precession appears in a range lower than 90 degrees with respect to the input, as a result of confirmations of a position where the gyro precession appears by trial and error, when the light-weighted main rotor blades made of a plastic material such as expanded polystyrene is mounted to the R/C helicopter configured to have a small size to be used indoors.

On the basis of the knowledge, in the rotor head of the R/C helicopter of the Bell-Hiller type that is configured to have the small size to be used indoors, the main rotor is adjusted such that the phase angle of the main rotor as the output with respect to the operation input becomes an acute angle lower than 90 degrees, that is, the main rotor is disposed around the mainmast such that the mounting position of the main rotor from the mainmast is advanced by the appropriate angle, and the main rotor and the stabilizer are configured to rotate with the phase difference of the acute angle.

It can be confirmed that operability is greatly improved that when the R/C helicopter comprising the rotor head is made to fly, the airframe does not shake and maintains the stable flying posture and even when the flying direction is changed, the flying posture is not collapsed, the behavior of the airframe is stabilized, and the smooth flying in a desired direction is enabled.

It is thought that in the R/C helicopter of the Bell-Hiller control type, due to a change of the rotation surface of the main rotor which is made by the cyclic pitch control and the stabilizer which seesaws above the mainmast as well as the position of the main rotor is advanced by an appropriate angle and the main rotor is disposed such that the phase difference with the stabilizer becomes the acute angle, a direction of the force applied to the airframe by the gyro precession in the rotation surface of the main rotor and a control direction of the airframe are matched with each other, and the arrangement of the main rotor is appropriate.

According to the present invention, in the rotor head of the R/C helicopter that is configured to have the small size and the light weight, the phase angle of the main rotor with respect to the operation input from the swash plate is adjusted in a range of the acute angle, not 90 degrees, and the phase angle of the rotation of the main rotor and the stabilizer is also set to the acute angle. As a result, the flying operation of the R/C helicopter can be stabilized and the operability can be greatly improved.

Accordingly, the problem according to the related art in that the control operation of the indoor helicopter is difficult can be resolved. Even when the setting place of the airframe or the transmitter is not precisely adjusted and the operator lacks his/her operation skills, the operator can enjoy the control of the R/C helicopter indoors without difficulty.

According to the experiments of the inventors of the present invention, it is confirmed that the range of the phase difference of the rotation of the main rotor and the stabilizer is different depending on the configuration of the R/C helicopter, such as the weight or the size of the main rotor blade and the total weight of the airframe. For this reason, the optimal phase difference (angle) to achieve the stable flying needs to be appropriately adjusted and set according to the configuration of the R/C helicopter. Even in any case, when the main rotor blade is light-weighted, the gyro precession appears after being delayed by the angle lower than 90 degrees with respect to the input. In order to stabilize the flying operation, the phase difference of the rotation of the main rotor and the stabilizer needs to be maintained at the acute angle.

REFERENCE NUMERALS

Figure 1:
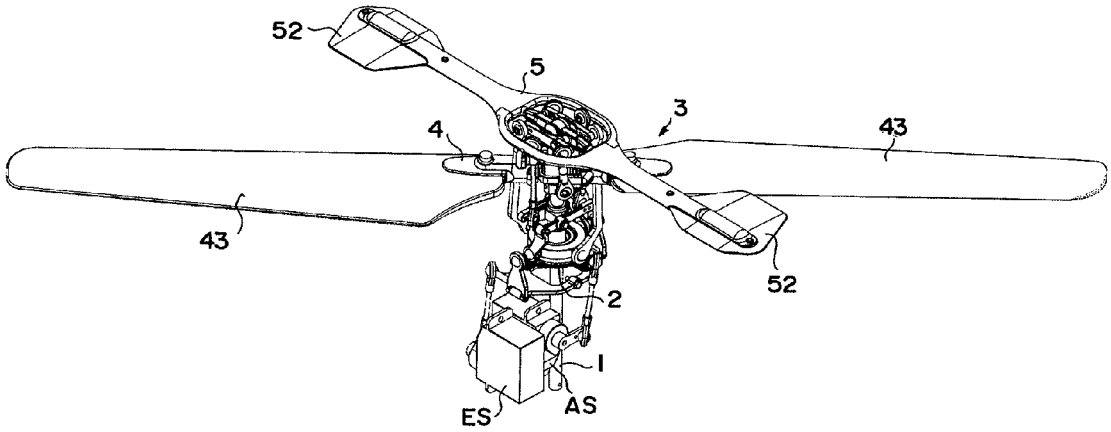
FIG. 1 is a perspective view of a mechanism for constituting a rotor head and a swash linkage of an R/C helicopter according to one embodiment of the present invention.

1: mainmast
2: swash plate
21: fixed swash
22: rotation swash
3: rotor head
4: main rotor
41: yoke
42: blade holder
43: main rotor blade
5: stabilizer
51: stabilizer bar
52: stabilizer blade

6: washout block
7: center hub
71: upper center hub
72: lower center hub
9: elevator lever
10: wash arm control
12: seesaw
13: stabilize control rod
14: mixing arm
15: mixing arm rod
ES: elevator servo
AS: aileron servo

BEST MODE FOR CARRYING OUT THE INVENTION

The preferred embodiment of the present invention will be described with reference to the accompanying drawings.

Figure 2:
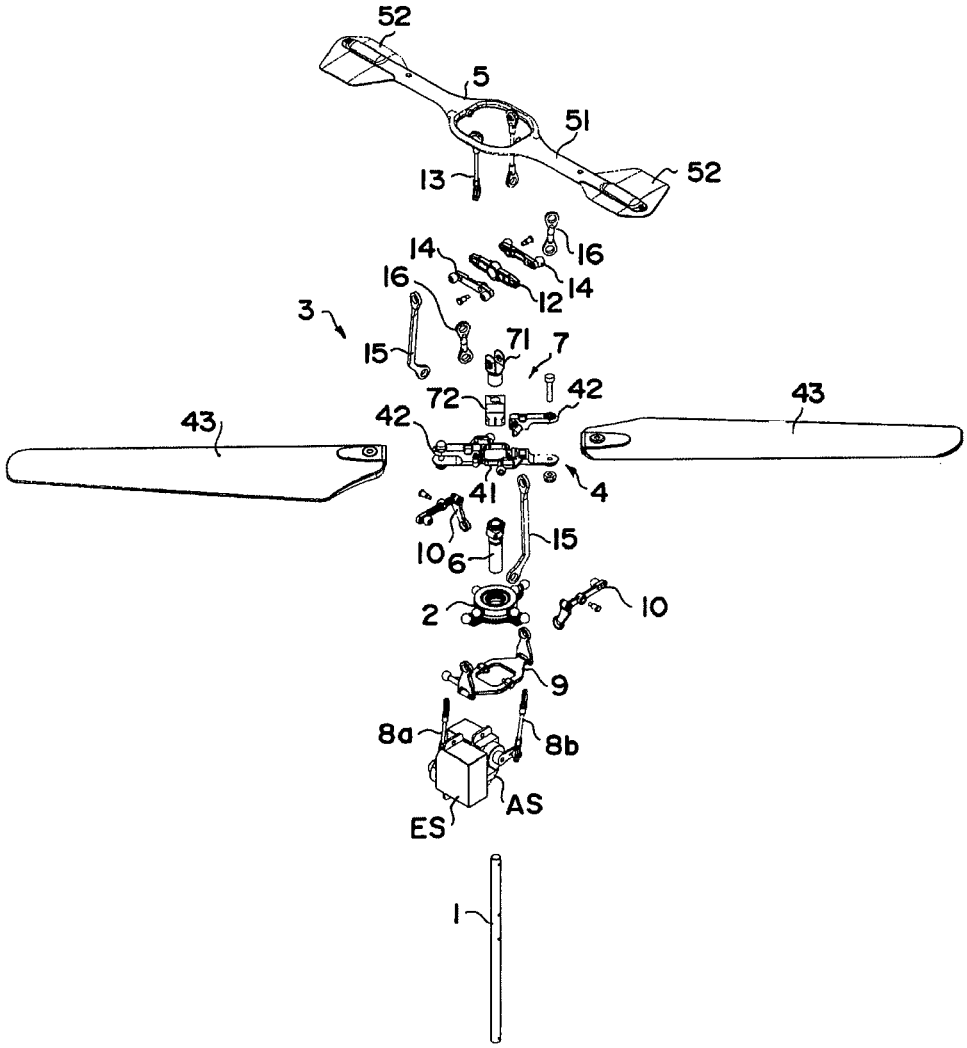
FIG. 2 is a development perspective view of constituent members of the mechanism of FIG. 1.
Figure 3:
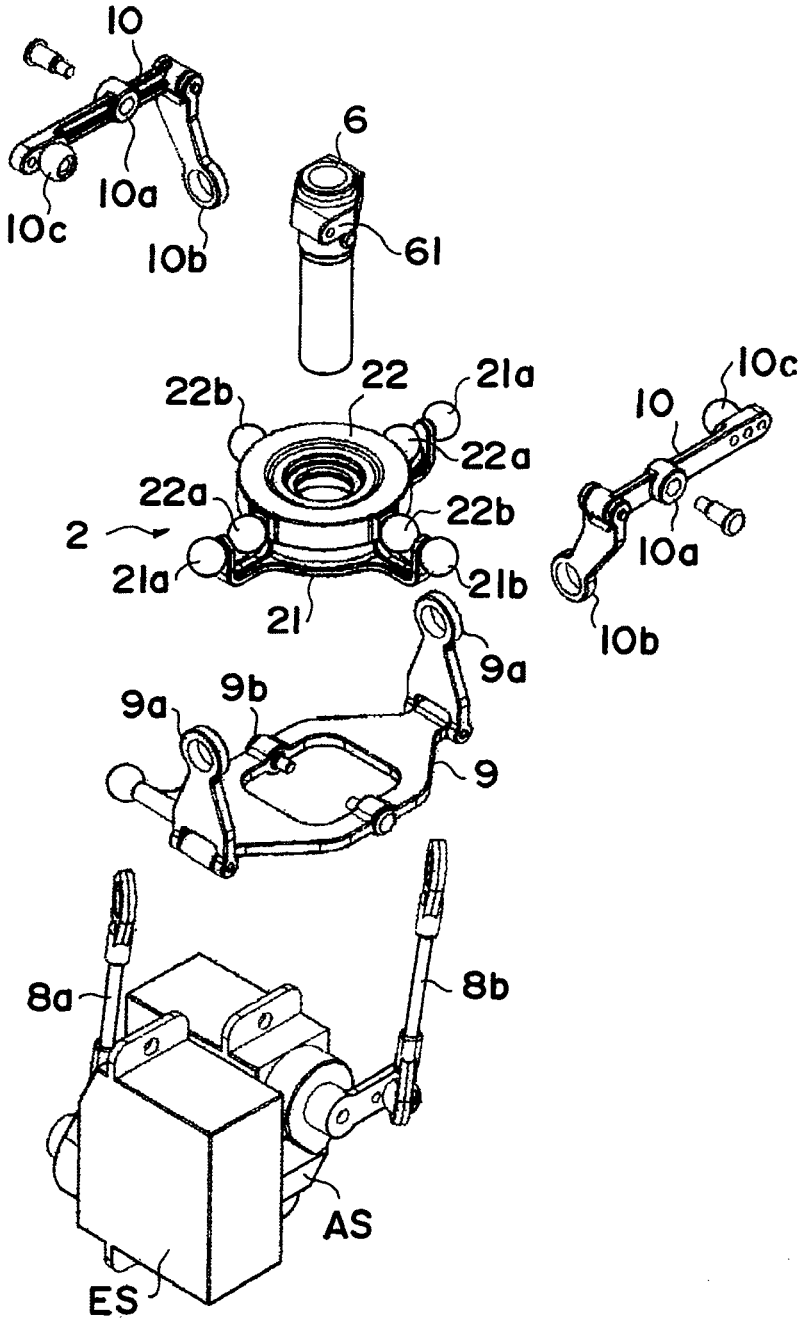
FIG. 3 is a development enlarged view of constituent members of a peripheral section of a swash plate in FIG. 2.
Figure 4:
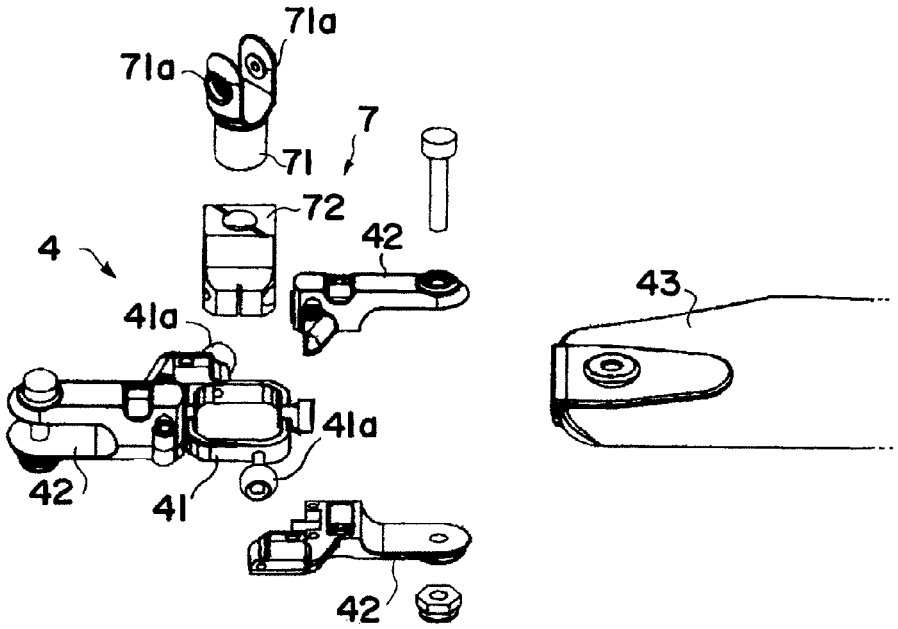
FIG. 4 is a development enlarged view of constituent members of a peripheral section of a main rotor in FIG. 2.
Figure 5:
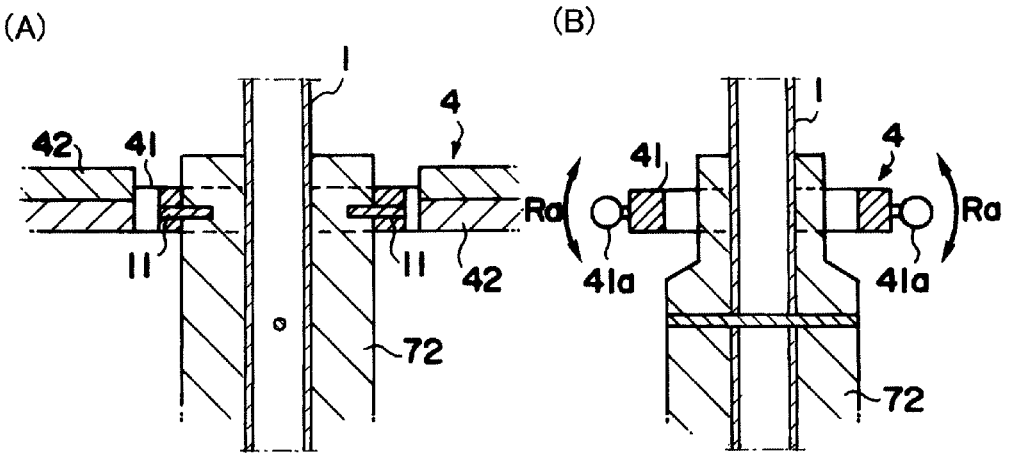
FIGS. 5A and 5B are enlarged longitudinal cross-sectional views of essential parts of a connecting portion of a main rotor and a mainmast.
Figure 6:
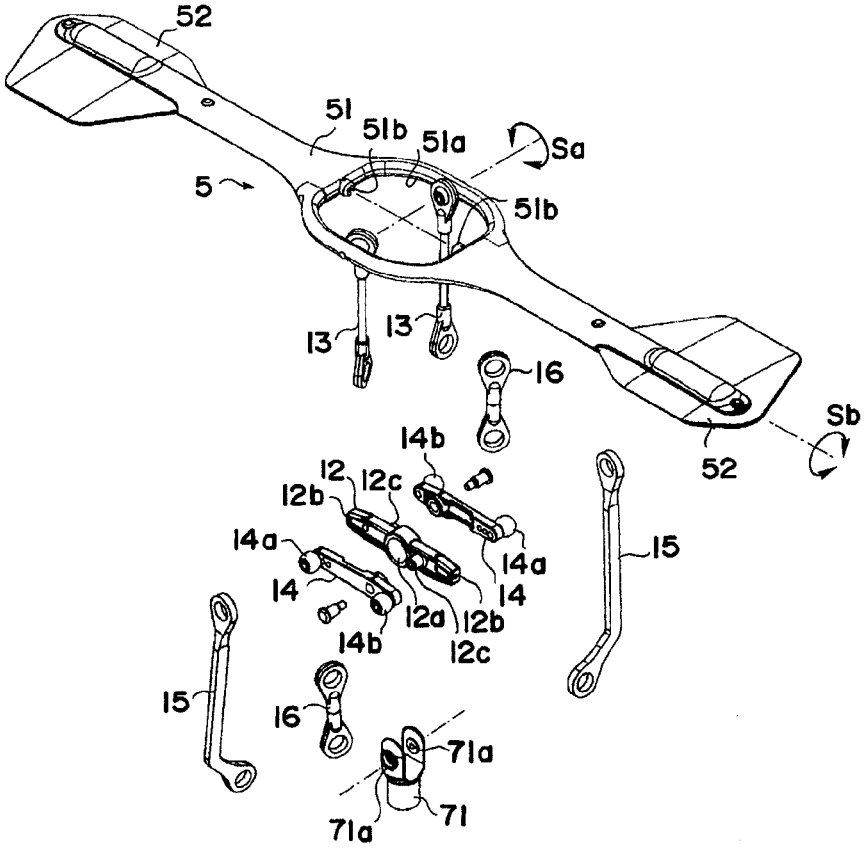
FIG. 6 is a development enlarged view of constituent members of a peripheral section of a stabilizer in FIG. 2.
Figure 7:
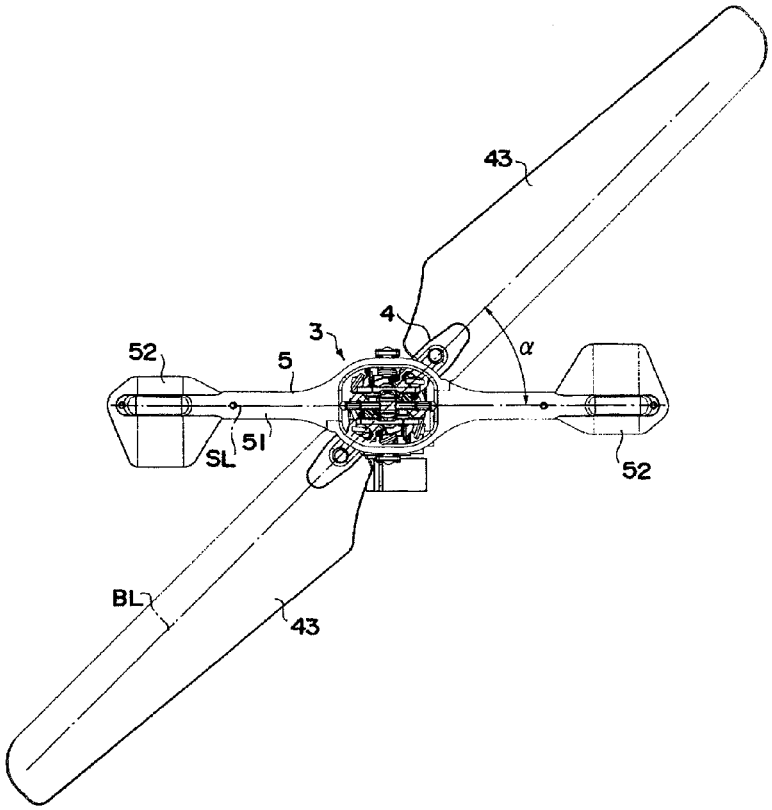
FIG. 7 is a plan view of the mechanism illustrated in FIG. 1.

FIG. 1 is a perspective view of a mechanism for constituting a rotor head and a swash linkage of an R/C helicopter according to the present invention. FIG. 2 is a development perspective view of constituent members of the mechanism of FIG. 1. FIG. 3 is a development enlarged view of constituent members of a peripheral section of a swash plate. FIG. 4 is a development enlarged view of constituent members of a peripheral section of a main rotor. FIG. 5 is an enlarged cross-sectional view of essential parts of a connecting portion of a main rotor and a mainmast. FIG. 6 is a development enlarged view of constituent members of a peripheral section of a stabilizer. FIG. 7 is a plan view of the mechanism illustrated in FIG. 1.

In the individual drawings, reference numeral 1 denotes a mainmast, reference numeral 2 denotes a swash plate, reference numeral 3 denotes a rotor head including a main rotor 4 and a stabilizer 5, an ES denotes an elevator servo, and an AS denotes an aileron servo.

The embodiment that is illustrated in the drawings is configured such that a pitch angle of a main rotor blade is controlled by a Bell-Hiller control method. The present invention is applied to an R/C helicopter having the configuration where an airframe is light-weighted and small-sized to be used indoors.

In the description below, although not described, as other members constituting the R/C helicopter, such as a main frame or a tail rotor of the R/C helicopter, motors driving backward and forward rotors, and a receiving device of a steering signal, members that are already known in the related art can be used.

The mainmast 1 protrudes its upper portion to the upper side of an airframe which is not illustrated, couples its lower portion to a driving shaft of a motor provided in the airframe through a gear, and is mounted to rotate by driving of the motor. In an outer circumferential portion of the upper portion of the mainmast 1, a cylindrical washout block 6 is mounted. In an upper end of the mainmast 1, a center hub 7 that supports the rotor head 3 is mounted and fixed to rotate integrally with the mainmast 1.

As illustrated in FIG. 2, the center hub 7 has a structure where the center hub is divided into an upper center hub 71 fixed to the upper end of the mainmast 1 and a lower center hub 72 fixed to an outer circumferential surface of the mainmast 1 at the side lower than the upper center hub 71. A seesaw 12 to be described in detail below and the stabilizer 5 are mounted to the upper center hub 71, and the main rotor 4 is mounted to the lower center hub 72.

The upper and the lower center hubs 71 and 72 are appropriately fixed around the shaft of the mainmast 1 with a predetermined angle, that is, a predetermined position from the mainmast 1. As a result, an intersection angle of the main rotor 4 and the stabilizer 5 around the shaft of the mainmast 1, that is, a phase difference of the rotations of both members can be set to an appropriate angle. As will be described below, in this embodiment, the phase difference is set to about 45 degrees.

As illustrated in FIG. 3, the swash plate 2 is configured to rotably support a rotation swash 22 where pivots 22*a* and 22*b* protrude in four circumferential directions through a bearing (not illustrated), at the upper side of a fixed swash 21 where pivots 21*a* and 21*b* protrude in three circumferential directions.

The swash plate 2 causes the mainmast 1 to pass through an opening formed in the center thereof and is mounted inclineably around the shaft in a direction orthogonal to the mast as the center.

That is, on the lower side of the swash plate 2, an elevator lever 9 having a horizontally long frame shape that is connected to a servo horn of the elevator servo ES through a rod 8*a* is disposed, and both ends 9*a* and 9*a* of the elevator lever 9 that can be inclined are connected to the pivots 21*a* and 21*a* of outer circumference facing positions of the fixed swash 21. In the elevator lever 9, its center portions 9*b* and 9*b* are connected in a main frame which is not illustrated to freely rotate. A servo horn of the aileron servo AS is connected to the pivots 21*b* that are disposed at the positions 90 degrees shifted from both pivots 21*a* of the fixed swash 21 at the facing positions, through a rod 8*b*. On both sides of the washout block 6 that is fixed to just above the mainmast 1 on the swash plate 2, wash control arms 10 and 10 are disposed. Center portions 10*a* and 10*a* of the wash control arms 10 are connected in an outer circumferential portion 61 of the washout block 6 to freely rotate, and rotatable ends 10*b* and 10*b* of the wash control arms 10 are connected to the pivots 22*a* and 22*a* of the rotation swash 22 at the facing positions to freely rotate.

When the elevator servo ES is driven and the rod 8*a* that is connected to the servo horn is elevated, with center portions 9*b* and 9*b* of the elevator lever 9 as the center, one of both ends of the elevator lever 9 ascends and the other descends. As a result, the fixed swash 21 and the rotation swash 22 are inclined around the mainmast 1 parallel to the elevator lever 9.

If the aileron servo AS is driven and the rod 8*b* that is connected to the servo horn is elevated, with a line segment connecting the pivots 21*a* and 21*a* of the fixed swash 21 as an axis, an end of the pivot 21*b* that the rod 8*b* of the fixed swash 21 is connected and an end that faces the end of the pivot 21*b* ascend or descend, and the fixed swash 21 and the rotation swash 22 are inclined around the mainmast 1.

The rotor head 3 that comprises the main rotor 4 and the stabilizer 5 is mounted above the swash plate 2 to rotate integrally with the mainmast 1 by the center hub 7 fixed to the mainmast 1, is connected to the swash plate 2 through a linkage, such as the wash control arm 10 or a mixing arm rod 15 to be described in detail below, and is mounted such that pitch angles of the main rotor 4 and the stabilizer 5 change by the inclining operation of the swash plate 2.

The main rotor 4 is formed to have the light weight as a whole using main rotor blades 43 made of expanded polystyrene. As illustrated in FIGS. 2 and 4, the main rotor 4 comprises a yoke 41 that is formed by protruding the pivots 41*a* and 41*a* backward and forward, a pair of upper and lower blade holders 42 and 42 that are fixed to both sides of the yoke 41, and main rotor blades 43 and 43 that are mounted integrally to both sides of the yoke 41 at predetermined pitch angles, by causing an insertion bolt to penetrate a base end from both a top surface and a bottom surface by the blade holders 42 and 42.

The main rotor 4 mounts the yoke 41 to an outer circumferential portion of an upper portion of the lower center hub 72 fixed to the mainmast 1, inclines the yoke 41 in an axial direction orthogonal to the mainmast 1 while rotating integrally with the mainmast 1, appropriately inclines the entire main rotor 4, and changes the pitch angles of the main rotor blades 43 and 43.

Specifically, as illustrated in FIG. 5, in a state where the yoke 41 is mounted to the outer circumferential portion of the lower center hub 72, the yoke 41 protrudes pins 11 and 11 from a facing inner circumferential surface thereof and is connected on an outer circumferential surface of the lower center hub 72 to freely rotate. In the pivots 41*a* and 41*a* of the yoke 41, one end of pitch rods 16 and 16 to be described in detail below is connected to freely rotate. As illustrated in FIG. 5B, if the pivots 41*a* and 41*a* are displaced upward and downward by the pitch rods 16 and 16, the entire main rotor 4 is inclined in an arrow direction Ra around the lower center hub 72 with the pin 11 and 11 as a fulcrum, and the pitch angles of the main rotor blades 43 and 43 with respect to the mainmast 1 change.

As illustrated in FIGS. 2 and 6, the stabilizer 5 is configured by mounting stabilizer blades 52 and 52 integrally to both sides of a stabilizer bar 51 having its center portion as a frame-shaped opening 51*a*.

The stabilizer 5 supports the opening 51*a* to the upper center hub 71 fixed to the upper end of the mainmast 1 through the seesaw 12, and is mounted to rotate integrally with the mainmast 1, with a phase difference of about 45 degrees with the main rotor 4.

Specifically, the upper center hub 71 that has an upper portion curved in a U shape is fixed to the upper end of the mainmast 1, and pivots a center portion 12*a* of the seesaw 12 to shaft portions 71*a* and 71*a* provided in the U-shape curved portion of the upper center hub 71 to freely rotate. The upper center hub 71 is fixed at an angle shifted from an angle of the lower center hub 72 around the shaft of the mainmast 1. If an axis line connecting the shaft portions 71*a* and 71*a* is projected onto an axis line connecting both pins 11 and 11 that pivot the main rotor 4 to the lower center hub 72 to freely rotate, both axis lines cross each other at an angle of about 45 degrees, and the main rotor 4 and the stabilizer 5 that are mounted to the upper and lower center hubs 71 and 72 rotate with a phase difference of about 45 degrees.

The stabilizer 5 tacks bearings 51*b* and 51*b* provided in the opening 51*a* of the stabilizer bar 51 on the both ends 12*b* and 12*b* of the seesaw 12 supported to the upper center hub 71 to freely rotate, by means of pins which is not illustrated. As illustrated in FIG. 6, the entire stabilizer 5 seesaws together with the seesaw 12 along an arrow direction Sa with the shaft portions 71*a* and 71*a* of the upper center hub 71 as a fulcrum, and the stabilizer blades 52 and 52 are inclined along an arrow direction Sb with a line connecting the bearings 51*b* and 51*b* as an axis.

In center portions of inner surfaces of both sides of the opening 51*a* of the stabilizer 51, one end of the stabilizer control rods 13 and 13 is respectively connected to freely rotate, and the other ends thereof are connected to the pivots 10*c* and 10*c* provided in the other ends of the wash control arms 10 and 10 to freely rotate.

On both sides of the seesaw 12, bearings 12*c* and 12*c* are provided at symmetrical positions that are apart from the center portions 12*a* at an equivalent interval, and mixing arms 14 and 14 are rotatably pivoted to the bearings 12*c* and 12*c* by means of pins.

In the mixing arms 14 and 14, the lengths from the shaft portions pivoted to the bearings 12*c* to both ends are different. In pivots 14*a* that are provided in long-side ends, one of the mixing arm rods 15 is rotatably connected. In pivots 14*b* that are provided in short-side ends, one end of the pitch rods 16 is rotatably connected. The other ends of the mixing arm rods 15 and 15 are rotatably connected to the pivots 22*b* and 22*b* of the rotation swash 22, and the other ends of the pitch rods 16 and 16 are rotatably connected to the pivots 41*a* and 41*a* of the yoke 41 of the main rotor 4. By these arms and rods, the swash linkage is configured.

According to the rotor head 3 of the R/C helicopter of this embodiment that is configured in the above-described way, if the elevator servo ES or the aileron servo AS is driven and both servo horns are operated, the ends of the rods 8*a* and 8*b* that are connected to the individual servo horns are displaced upward and downward, and the swash plate 2 is appropriately inclined around the mainmast 1. As a result, the mixing arm rods 15 and 15 that are connected to the pivots of the circumferential sides of the rotation swash 22 the wash control arms 10 and 10 are displaced to change the pitch angles of the main rotor blades 43 and 43 and the stabilizer blades 52 and 52.

That is, the displacements of the mixing arm rods 15 and 15 according to the inclination of the swash plate 2 are transmitted to the main rotor 4 through the mixing arms 14 and 14 and the pitch rods 16 and 16, and the main rotor blades 43 and 43 are inclined in an arrow direction Ra of FIG. 5 to change the pitch angles. The displacements of the wash control arms 10 and 10 cause the stabilizer control rods 13 and 13 to operate, thereby inclining the entire stabilizer 5 in an arrow direction Sb of FIG. 6 and changing the pitch angles of the stabilizer blades 52 and 52.

If the stabilizer blades 52 and 52 receive a wind pressure, the entire stabilizer 5 seesaws together with the seesaw 12 in an arrow direction Sa of FIG. 6 with the shaft portions 71*a* and 71*a* of the upper center hub 71 as a fulcrum. By the seesaw operation, the mixing arms 14 and 14 rotate around the seesaw 12 and the displacements thereof are transmitted to the main rotor 4 through the pitch rods 16 and 16, thereby inclining the main rotor 4 and changing the pitch angles of the main rotor blades 43 and 43.

If the main rotor 4 is inclined and the pitch angles of the main rotor blades 43 and 43 are changed, a gyro precession acts on the main rotor 4. However, since the main rotor blades 43 and 43 are formed of a light-weighted material and the main rotor 4 is configured to have the light weight, the gyro precession appears after being delayed by about 45 degrees with respect to a rotation direction of the main rotor 4.

In this embodiment as illustrated in FIG. 7, when an axis line BL connecting between fore-end of the main rotor blades 43 and 43 running through the shaft of the mainmast 1 and an axis line SL connecting between fore-end of the stabilizer blades 52 and 52 running through the shaft of the mainmast 1 are projected onto the surface orthogonal to the mainmast 1, an intersection angle $\alpha$ of both axis lines becomes about 45 degrees, and the main rotor blades 43 and 43 and the stabilizer blades 52 and 52 are configured to integrally rotate with a phase difference of about 45 degrees. Accordingly, if the pitch angles of the main rotor blades 43 and 43 change and a direction of force of the gyro precession acting on the airframe and a control direction of the airframe become matched with each other, the flying operation of the R/C helicopter can be stabilized.

EXAMPLE

The rotor head 3 of this embodiment is mounted to an airframe of an indoor helicopter to constitute an R/C helicopter. The total weight of the airframe including electrical components, such as a motor, a receiving device, and a battery is 150 g. The main rotor blade 43 is made of expanded polystyrene, and its total length (L) from the base end to the fore-end is 153 mm and its weight is 2 g. The fixed positions of the upper and the lower center hubs 71 and 72 are adjusted and a phase difference (intersection angle $\alpha$) of the main rotor 4 and the stabilizer 5 is set to about 45 degrees.

COMPARATIVE EXAMPLE

The airframe, the rotor head 3, and the main rotor blade 43 that are the same as those in the said embodiment are used, the fixed positions of the upper and the lower center hubs 71 and 72 are adjusted, and a phase difference (intersection angle $\alpha$) of the main rotor 4 and the stabilizer 5 is set to about 90 degrees, thereby constituting an R/C helicopter.

When the R/C helicopter according to the comparative example is made to fly by the remote control, if the operation stick of the transmitter is operated, the flying posture is collapsed, the airframe shakes, control of a flying direction of the airframe is difficult to be smoothly performed, and the control operation is difficult.

Meanwhile, in the R/C helicopter according to the embodiment, if the operation stick of the transmitter is operated, the airframe smoothly flies in an operation direction without shaking, and the flying direction can be stably controlled without collapsing the flying posture. As a result, it is confirmed that operability is improved in the airframe according to the embodiment, as compared with the airframe according to the comparative example.

In the R/C helicopter according to the embodiment, it is confirmed that the flying stability and the operability are improved by appropriately setting the phase difference (intersection angle $\alpha$) of the main rotor 4 and the stabilizer 5. As a result, it is confirmed that the flying is stable, if the phase difference is in a range of 30 to 60 degrees. Among them, when the phase difference is in a range of 40 to 50 degrees, the flying is most stable, the flying direction is controlled without collapsing the flying posture, and the operability is most superior.

The embodiment illustrated in the drawings is only exemplary, and the present invention can be applied to an R/C helicopter of another preferable embodiment. In the embodiment illustrated in the drawings, the main rotor blades are disposed as fixed pitches to constitute the main rotor. However, the main rotor may be configured by mounting a pitch servo, such that the pitch angles are controlled by collective pitch control. The swash linkage that connects the rotor head and the swash plate can be appropriately configured, and the configuration of the Bell type or the Hiller type is enabled. The stabilizer bar may be disposed at the lower side of the main rotor to constitute the rotor head. The center hub is divided into the upper center hub and the lower center hub. However, if the phase difference of the optimal rotation of the main rotor and the stabilizer is clear according to the weight or configuration of the airframe of the R/C helicopter, the upper and the lower center hubs may be integrally configured.

What is claimed is:

1. A rotor head of a remotely controlled helicopter of a single rotor type, which is configured such that a stabilizer or a main rotor is connected to a swash plate through a link mechanism, and pitch angles of the stabilizer or the main rotor are controlled by inclining the swash plate, wherein the rotor head is configured such that a gyro precession of the main rotor as an output with respect to an operation input from the swash plate is not greater than 90 degrees, and the main rotor and the stabilizer are mounted to rotate with a phase difference of an acute angle, wherein the stabilizer is rotatable about an axis along the length-wise direction of the stabilizer.

2. The rotor head according to claim 1, wherein the rotor head has the configuration of a Bell-Hiller type where the stabilizer and the main rotor are connected to the swash plate through the link mechanism.

3. The rotor head according to claim 1, wherein configuration of the swash linkage that connects the rotor head and the swash plate is a Bell type or a Hiller type.

4. A remotely controlled helicopter comprising the rotor head according to claim 1.

5. A remotely controlled helicopter comprising the rotor head according to claim 2.

6. A remotely controlled helicopter comprising the rotor head according to claim 3.

* * * * *